US009175239B2

(12) United States Patent
Park et al.

(10) Patent No.: US 9,175,239 B2
(45) Date of Patent: Nov. 3, 2015

(54) BRAKE FLUID COMPOSITION COMPRISING TRIAZOLE AND THIADIAZOLE

(75) Inventors: Jae Yoon Park, Seoul (KR); Chang Yeol Jo, Busan (KR); Hong Ki Lee, Gyeonggi-do (KR)

(73) Assignee: KUKDONG JEYEN COMPANY LIMITED, Gyeonggi-do (KR)

( * ) Notice: Subject to any disclaimer, the term of this patent is extended or adjusted under 35 U.S.C. 154(b) by 0 days.

(21) Appl. No.: 14/356,163

(22) PCT Filed: Jan. 31, 2012

(86) PCT No.: PCT/KR2012/000756

§ 371 (c)(1), (2), (4) Date: May 4, 2014

(87) PCT Pub. No.: WO2013/065903

PCT Pub. Date: May 10, 2013

(65) Prior Publication Data

US 2014/0274833 A1 Sep. 18, 2014

(30) Foreign Application Priority Data

Nov. 4, 2011 (KR) ..... 10-2011-0114214

(51) Int. Cl.

| | |
|---|---|
| ***C10M 163/00*** | (2006.01) |
| ***C10M 139/00*** | (2006.01) |
| ***C10M 135/32*** | (2006.01) |
| ***C10M 133/44*** | (2006.01) |
| ***C10M 107/34*** | (2006.01) |
| ***C10M 141/08*** | (2006.01) |
| ***C10M 169/04*** | (2006.01) |
| ***C23F 11/10*** | (2006.01) |
| *C10M 129/10* | (2006.01) |
| *C10M 129/16* | (2006.01) |
| *C10M 135/36* | (2006.01) |

(52) U.S. Cl.

CPC ..... *C10M 141/08* (2013.01); *C10M 133/44* (2013.01); *C10M 169/04* (2013.01); *C23F 11/10* (2013.01); *C10M 129/10* (2013.01); *C10M 129/16* (2013.01); *C10M 135/36* (2013.01); *C10M 139/00* (2013.01); *C10M 2207/023* (2013.01); *C10M 2207/026* (2013.01); *C10M 2207/0225* (2013.01); *C10M 2207/046* (2013.01); *C10M 2209/1033* (2013.01); *C10M 2209/1045* (2013.01); *C10M 2215/02* (2013.01); *C10M 2215/04* (2013.01); *C10M 2215/042* (2013.01); *C10M 2215/044* (2013.01); *C10M 2215/223* (2013.01); *C10M 2219/106* (2013.01); *C10M 2227/00* (2013.01); *C10M 2227/061* (2013.01); *C10M 2227/0615* (2013.01); *C10N 2230/10* (2013.01); *C10N 2230/12* (2013.01); *C10N 2240/08* (2013.01)

(58) Field of Classification Search

CPC ..... C10M 2227/061; C10M 2207/282; C10M 2219/106; C10M 2215/22; C10M 2207/34

USPC ..... 508/185, 198, 269, 273, 279, 497

See application file for complete search history.

(56) References Cited

U.S. PATENT DOCUMENTS

| | | | | |
|---|---|---|---|---|
| 5,817,605 | A | 10/1998 | Papay | |
| 6,339,050 | B1 * | 1/2002 | Park | 508/198 |

FOREIGN PATENT DOCUMENTS

| | | | |
|---|---|---|---|
| JP | 59157188 | A * | 9/1984 |
| JP | 2008-537008 | A | 9/2008 |
| KR | 10-0600100 | B1 | 7/2006 |
| KR | 10-0748779 | B1 | 8/2007 |

OTHER PUBLICATIONS

International Search Report for PCT/KR2012/000756.

* cited by examiner

*Primary Examiner* — Vishal Vasisth

(74) *Attorney, Agent, or Firm* — The PL Law Group, PLLC

(57) ABSTRACT

The present invention relates to a brake fluid composition comprising a glycol compound as a solvent, and triazole, thiadiazole mixture, and antioxidant as metallic corrosion inhibitors. Provided is a brake fluid composition having improved long-term metallic and high-temperature corrosion inhibition. The brake fluid composition according to the present invention significantly improves long-term durability by being a superior anti-corrosive as well as having a reduced weight variation on a test piece, and has a superior high-temperature corrosion inhibition while having negligible effects on the equilibrium reflux boiling point and the wet equilibrium reflux boiling point.

2 Claims, No Drawings

BRAKE FLUID COMPOSITION COMPRISING TRIAZOLE AND THIADIAZOLE

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2012/000756, filed Jan. 31, 2012, which claims priority to Korean Patent Application No. 10-2011-0114214, filed Nov. 4, 2012, entire contents of which are incorporated herein by reference.

TECHNICAL FIELD

The present invention relates to a brake fluid composition.

BACKGROUND ART

The present invention relates to a brake fluid composition for a vehicle, which is used in a brake device for a vehicle system, the brake fluid composition containing a solvent, a metal corrosion inhibitor, and an antioxidant. More particularly, the present invention relates to a brake fluid composition for a vehicle, capable of improving the metal corrosion inhibiting performance by containing a glycol mixture as a solvent, a mixture of triazole and thiadiazole as an anti-corrosive agent, an antioxidant, and a stabilizer.

Brake fluid plays an important role of accurately transferring the pressure generated from a master cylinder to a wheel cylinder. Problems occurring during this procedure cause deterioration in brake responsiveness. The brake fluid needs to meet several requirements associated with its chemical and physical properties. Of these, the first requirement is a high equilibrium reflux boiling point (ERBP). The brake fluid itself is difficult to boil. However, the brake fluid has a high temperature at the time of braking, and thus may boil under particular circumstances. If the brake fluid boils, the pressure of the master cylinder may not be accurately transferred, so a stable brake force cannot be expected. Meanwhile, the temperature of frictional heat caused by the frequent use of a disk brake in a brake system is about 800° C. The brake fluid receiving this high-temperature heat is thermally oxidized, resulting in degradation in the metal corrosion-inhibiting capability, causing safety accidents. The second requirement is a high wet equilibrium reflux boiling point. The brake fluid, which is a hygroscopic liquid, is required to have low hygroscopic property, but it is important to prevent the drop in the boiling point of the brake fluid even when the brake fluid absorbs moisture. The reasons are that when the brake fluid absorbs moisture in the atmosphere and thus lowers its boiling point, this may lead to vapor lock, causing safety accidents. In addition, the viscosity change of the brake fluid needs to be small even within a wide temperature range. In addition, a metal corrosion inhibitor and an oxidation stabilizer, which can prevent the corrosion of various kinds of metals present in the braking device to enhance their durability, are added to the brake fluid.

In the case of the generally used brake fluids, only a glycol ether compound is used as a solvent, or about 30-50 wt % of a boron ester compound is added to the solvent. The brake fluid containing only the glycol ether compound absorbs moisture in the atmosphere if used for a long period of time, and thus lowers its wet boiling point, resulting in the vapor lock, causing a risk of the brake failure which may lead to an accident. Moreover, the metal corrosion-preventing capability of this brake fluid is poor. Also, the brake fluid with about 30-50 wt % of a boron ester compound raises its equilibrium reflux boiling point and wet boiling point by using the boron ester compound, and thus has a higher degree of safety than the brake fluid using only the glycol ether compound. However, this brake fluid may corrode metal components by a boronic acid, which is deposited due to hydrolysis of the boron ester compound when moisture is absorbed. The protection of metals and nonferrous metals against the corrosion by these brake fluids can be achieved by an additive for corrosion inhibition and an antioxidant.

SUMMARY

Therefore, the present inventors have endeavored to solve the above-mentioned problems. As a result, the present inventors have verified that a brake fluid composition further including triazole and thiadiazole in addition to the conventional brake fluid composition can enhance the capabilities to inhibit long-term metal corrosion and high-temperature metal corrosion and reduce the metal weight change as compared with the conventional brake fluid composition, and then have completed the present invention.

Accordingly, an aspect of the present invention is to provide a brake liquid composition.

Other purposes and advantages of the present invention will be clarified by the following detailed description of invention, claims, and drawings.

DETAILED DESCRIPTION

In accordance with an aspect of the present invention, there is provided a brake fluid composition including a glycol compound as a solvent, a mixture of triazole and thiadiazole as a metal corrosion inhibitor, and an antioxidant.

The present inventors have endeavored to solve the above-mentioned problems. As a result, the present inventors have verified that a brake fluid composition further including triazole and thiadiazole in addition to the conventional brake fluid composition can enhance the capabilities to inhibit long-term metal corrosion and high-temperature metal corrosion and reduce the metal weight change as compared with the conventional brake fluid composition, and then have completed the present invention.

As used herein, the term "brake fluid" refers to a non-petroleum-based liquid for a hydraulic brake of a vehicle, which is used for a braking device of a car (transporting vehicle), and a liquid material used to accurately transfer the pressure, which is generated from a master cylinder at the time of driving, to a wheel cylinder.

In the composition of the present invention, any glycol compound known in the art may be used as the solvent. The glycol compound is preferably selected from the group consisting of ethylene glycol, diethylene glycol, triethylene glycol, methylene glycol, dimethylene glycol, trimethylene glycol, propylene glycol, dipropylene glycol, butylene glycol, polyalkylene glycol, glycol ether, and a mixture thereof. More preferably, the glycol compound suitable for the composition of the present invention is ethylene glycol, diethylene glycol, propylene glycol, dipropylene glycol, polyalkylene glycol, or glycol ether.

In the composition of the present invention, any glycol ether known in the art may be used. Preferably, the glycol ether is selected from the group consisting of ethylene glycol ethyl ether, diethylene glycol ethyl ether, triethylene glycol ethyl ether, ethylene glycol methyl ether, diethylene glycol methyl ether, triethylene glycol methyl ether, polyethylene glycol methyl ether, ethylene glycol butyl ether, diethylene glycol butyl ether, triethylene glycol butyl ether, polyethylene glycol butyl ether, dipropylene glycol methyl ether, polypropylene glycol methyl ether, and a mixture thereof. More preferably, the glycol ether suitable for the composition of the present invention is ethylene glycol methyl ether, diethylene glycol methyl ether, triethylene glycol methyl ether, polyethylene glycol methyl ether, ethylene glycol butyl ether, diethylene glycol butyl ether, triethylene glycol butyl ether, or polyethylene glycol butyl ether. Most preferably, the glycol ether is triethylene glycol mono-methyl ether, polyethylene glycol mono-methyl ether, or polyethylene glycol mono-butyl ether.

According to a more preferable embodiment of the present invention, the glycol compound as a solvent used herein is a mixture of polyalkylene glycol and glycol ether.

In the composition of the present invention, the content of the glycol compound as a solvent is preferably 20-99 wt %, more preferably 40-99 wt %, still more preferable 60-99 wt %, still more preferably 70-99 wt %, and most preferably 85-99 wt %, based on the total weight of the composition.

When the polyalkylene glycol and glycol ether are used as a solvent, the content of polyalkylene glycol is preferably 1.0-80 wt %, more preferably 1.0-70 wt %, still more preferably 5.0-50 wt %, and still more preferably 5.0-30 wt %, based on the total weight of the solvent. The content of glycol ether is preferably 20-90 wt %, more preferably 30-80 wt %, still more preferably 50-80 wt %, and still more preferably 70-85 wt %, based on the total weight of the solvent.

According to a preferable embodiment of the present invention, the composition of the present invention further includes a boron-containing compound as a solvent. The boron-containing compound is preferably selected from the group consisting of boron, a boron compound, sodium borate, and potassium borate, more preferably a boron compound, and still more preferably a boron ester compound. Most preferably, the boron-containing compound is tris[2-[2-(2-methoxyethoxy)ethoxy]ethyl]orthoborate.

The brake fluid composition of the present invention essentially includes a mixture of triazole and thiadiazole as a metal corrosion inhibitor. As validated in the following examples, the mixture of triazole and thiadiazole has excellent performance in long-term metal corrosion inhibition and high-temperature metal corrosion inhibition.

The triazole usable herein includes various triazole compounds known in the art. The triazole is preferably selected from the group consisting of benzotriazole, tolyltriazole, octyltriazole, decyltriazole, dodecyltriazole, and a mixture thereof. More preferably, the triazole usable herein is bentriazole or tolyltriazole.

The thiadiazole useable herein includes various thiadiazoles known in the art, and is preferably selected from the group consisting of 2.5-dimercapto-1,3,4-thiadiazole, 2-mercapto-5-hydrocarbylthio-1,3,4-thiadiazole, 2-mercapto-5-hydrocarbyldithio-5-1,3,4-thiadiazole, 2,5-bis(hydrocarbylthio)-1,3,4-thiadiazole, 2,5-bis(hydrocarbyldithio)-1,3,4-thiadiazole, and a mixture thereof. More preferably, the thiadiazole useable herein is 2.5-dimercapto-1,3,4-thiadiazole.

In the composition of the present invention, the preferable content of the mixture of triazole and thiadiazole as a metal corrosion inhibitor is 0.1-10 wt %, and more preferably 0.5-10 wt %, based on the total weight of the composition. In the mixture of triazole and thiadiazole as a metal corrosion inhibitor, the weight ratio of two components, triazole:thiadiazole is 0.1:1 to 1:0.1.

The brake fluid composition of the present invention includes an antioxidant. The antioxidant suitable for the present invention includes various antioxidants known in the art. According to a preferable embodiment of the present invention, the brake fluid composition of the present invention includes one or one or more antioxidants selected from the group consisting of dibutyl hydroxy toluene, butyl hydroxy anisole, and triphenyl phosphate. More preferably, dibutyl hydroxy toluene is used as the antioxidant of the present invention.

In the composition of the present invention, the content of the antioxidant is preferably 0.1-5.0 wt % and more preferably 0.1-5.0 wt % based on the total weight of the composition.

In the brake fluid composition including a glycol compound, a mixture of triazole and thiadiazole as a metal corrosion inhibitor, and an antioxidant, the preferable contents are 85-99 wt % for the glycol compound, 0.1-10 wt % for the metal corrosion inhibitor, and 0.1-5.0 wt % for the antioxidant.

According to a preferable embodiment of the present invention, the brake fluid composition of the present invention further includes an amine compound as the metal corrosion inhibitor. Preferably, the amine is selected from alkyl diethanol amine (e.g., methyl diethanol amine), monoethanol amine, diethanol amine, triethanol amine, dicyclohexyl amine, morpholine, phenyl morpholine, ethanol amine, di-(2-ethylhexyl)amine, di-N-butyl amine, monoamyl amine, diamyl amine, dioctyl amine, salicyl monoethanol amine, and di-beta-naphthyl-p-phenylene diamine.

In the composition of the present invention, the content of the amine compound is preferably 0.1-10 wt % and more preferably 0.1-5.0 wt %, based on the total weight of the composition.

According to a preferable embodiment of the present invention, the brake fluid composition of the present invention further includes a boron-containing compound as a solvent. More preferably, the boron-containing compound is selected from the group consisting of a boric acid, sodium borate, and potassium borate, and still more preferably selected from borate ester compounds. Most preferably, the boron-containing compound is tris[2-[2-(2-methoxyethoxy)ethoxy]ethyl]orthoborate.

In the composition of the present invention, the content of the boron-containing compound is preferably 10-70 wt %, more preferably 10-50 wt %, and still more preferably 10-40 wt %, based on the total weight of the composition.

The brake fluid composition of the present invention is very excellent in long-term metal corrosion inhibition and high-temperature metal corrosion inhibition. Therefore, the brake fluid composition of the present invention has excellent performance in long-term metal corrosion-inhibition, thereby improving corrosion resistance against metal materials, solving the problem in which the brake fluid boils at a high temperature, inhibiting the corrosion of neighboring metals, and preventing the oxidation of metals by heat.

Features and advantages of the present invention are summarized as follows:

(a) The brake fluid composition of the present invention is characterized by using a mixture of triazole and thiadiazole as a metal corrosion inhibitor and including an antioxidant.

(b) The present invention provides the brake fluid composition having enhanced performance in long-term metal corrosion inhibition and high-temperature metal corrosion inhibition.

(c) The brake fluid composition of the present invention has excellent corrosion resistance and a reduced change in the specimen weight and thus greatly enhances the durability, and has very excellent performance in high-temperature metal corrosion inhibition while having very little influence on the equilibrium reflux boiling point and the wet equilibrium reflux boiling point.

Hereinafter, the present invention will be described in detail with reference to examples. These examples are only for illustrating the present invention more specifically, and it will be apparent to those skilled in the art that the scope of the present invention is not limited by these examples.

EXAMPLES

Preparative Example

Brake fluid compositions of the present invention having the following compositions as shown in Table 1 were prepared.

TABLE 1

| Function | Composition (wt %) | Example 1 | Example 2 | Example 3 | Example 4 | Comparative Example 1 | Comparative Example 2 |
|---|---|---|---|---|---|---|---|
| Solvent | Polyalkylene glycol | 20 | 25 | 5 | 5 | 20 | 5 |
| | Polyethylene glycol monomethyl ether | 25 | 20 | 20 | 15 | 25 | 15 |
| | Polyethylene glycol monobutyl ether | 20 | 25 | 20 | 15 | 20 | 15 |
| | Triethylene glycol monomethyl ether | 30 | 25 | 20 | 15 | 30 | 15 |
| | Borate ester compound | — | — | 35 | 50 | — | 50 |
| Metal corrosion inhibitor | Benzotriazole | 0.5 | — | 0.5 | — | 0.5 | — |
| | Tolyltriazole | — | 0.5 | — | 0.5 | — | 0.5 |
| | 2.5 demercapto-1,3,4 thiadiazole | 0.5 | 0.5 | 0.5 | 0.5 | — | — |
| | Alkyl diethanol amine | 1.0 | — | 1.0 | 1.0 | 1.0 | — |
| | Cyclohexyl amine | 1.0 | 1.0 | — | — | 1.0 | 1.0 |
| | Triethanol amine | — | 1.0 | 1.0 | 1.0 | — | 1.0 |
| Antioxidant | Dibutyl hydroxy toluene | 0.5 | 0.5 | 0.5 | 0.5 | — | — |
| | 2.2-methylene-bis-(4-methyl-6-t-butyl phenol) | — | — | — | — | 0.5 | 0.5 |

Respective brake fluid compositions of examples and comparative examples were prepared according to the compositions shown in Table 1. The borate ester compound was tris [2-[2-(2-methoxyethoxy)ethoxy]ethyl]orthoborate. Here, respective components of each composition were stirred and mixed at room temperature (25° C.) for 1 hour, and then filtered by microfiltration (5 μm).

Experimental Examples

The performance of the brake fluid compositions (Table 1) of the examples and comparative examples were evaluated by conducting tests on long-term metal corrosion, high-temperature metal corrosion, antioxidation, equilibrium reflux boiling point, and wet equilibrium reflux boiling point, and then the test results were shown in Tables 2 to 5.

TABLE 2

| Test on long-term metal corrosion for respective compositions (100° C. × 1000 hr) | | | | | | | | |
|---|---|---|---|---|---|---|---|---|
| Classification | | | Example | Example | Example | Example | Comparative | Comparative |
| Item | Standard | | 1 | 2 | 3 | 4 | Example 1 | Example 2 |
| Long-term metal corrosion test ($mg/cm^2$) | Tin plate | ±0.2 | 0.03 | 0.04 | 0.04 | 0.04 | 0.11 | 0.12 |
| | Steel | ±0.2 | 0.05 | 0.05 | 0.05 | 0.06 | 0.25 | 0.38 |
| | Aluminum | ±0.1 | 0.05 | 0.04 | 0.05 | 0.06 | 0.28 | 0.55 |
| | Cast iron | ±0.2 | 0.06 | 0.05 | 0.05 | 0.06 | 0.24 | 0.48 |
| | Brass | ±0.4 | 0.07 | 0.08 | 0.07 | 0.09 | 0.52 | 0.71 |
| | Copper | ±0.4 | 0.06 | 0.07 | 0.06 | 0.06 | 0.62 | 0.85 |
| | Zinc | ±0.4 | 0.07 | 0.08 | 0.07 | 0.08 | 0.88 | 1.15 |

In order to evaluate the excellence of the brake fluid with respect to the long-term durability, the following test was conducted. The test on long-term metal corrosion was conducted according to the standard KS M 2141, and the results at 100° C. after 1000 hours were observed.

As a result of the test on long-term metal corrosion, as can be seen in Table 2, the brake fluids containing triazole and thiatriazole were 3 to 16 times better than the comparative examples (i.e., brake fluids not containing triazole and thiatriazole) in terms of the change in metal weight. This indicated that the triazole and thiatriazole enhance the capability of the brake fluid to inhibit long-term metal corrosion.

TABLE 3

| Test on high-temperature metal corrosion for respective compositions (120° C. × 120 hr) | | | | | | | | |
|---|---|---|---|---|---|---|---|---|
| Classification | | | Example | Example | Example | Example | Comparative | Comparative |
| Item | Standard | | 1 | 2 | 3 | 4 | example 1 | example 2 |
| High-temperature | Tin plate | ±0.2 | 0.01 | 0.02 | 0.01 | 0.02 | 0.08 | 0.09 |
| | Steel | ±0.2 | 0.02 | 0.02 | 0.02 | 0.03 | 0.11 | 0.11 |

TABLE 3-continued

| Test on high-temperature metal corrosion for respective compositions (120° C. × 120 hr) | | | | | | | | |
|---|---|---|---|---|---|---|---|---|
| Classification | | | Example | Example | Example | Example | Comparative | Comparative |
| Item | Standard | | 1 | 2 | 3 | 4 | example 1 | example 2 |
| metal corrosion test ($mg/cm^2$) | Aluminum | ±0.1 | 0.01 | 0.01 | 0.03 | 0.02 | 0.88 | 0.92 |
| | Cast iron | ±0.2 | 0.02 | 0.01 | 0.02 | 0.03 | 0.12 | 0.15 |
| | Brass | ±0.4 | 0.03 | 0.02 | 0.03 | 0.03 | 0.18 | 0.20 |
| | Copper | ±0.4 | 0.03 | 0.04 | 0.05 | 0.05 | 0.19 | 0.19 |
| | Zinc | ±0.4 | 0.04 | 0.04 | 0.05 | 0.06 | 0.31 | 0.35 |

In order to evaluate the excellence of the brake fluid with respect to the high-temperature durability, the following test was conducted. The test on high-temperature metal corrosion was conducted according to the standard KS M 2141, and results at 120° C. after 120 hours were observed.

As a result of the test on high-temperature corrosion, as can be seen in Table 3, the brake fluids containing triazole and thiatriazole were 5 to 8 times better than the comparative examples (i.e., brake fluids not containing triazole and thiatriazole) in terms of the change in metal weight. This indicated that the triazole and thiatriazole enhanced the capability of the brake fluid to inhibit high-temperature metal corrosion.

TABLE 4

| Test on antioxidation for respective compositions (23° C. × 70 hr + 70° C. × 168 hr) | | | | | | | | |
|---|---|---|---|---|---|---|---|---|
| Classification | | | Example | Example | Example | Example | Comparative | Comparative |
| Item | Standard | | 1 | 2 | 3 | 4 | example 1 | example 2 |
| Antioxidation ($mg/cm^2$) | Aluminum | ±0.05 | 0.01 | 0.01 | 0.01 | 0.01 | 0.03 | 0.04 |
| | Cast iron | ±0.3 | 0.02 | 0.02 | 0.02 | 0.02 | 0.12 | 0.14 |

In order to evaluate the excellence of the brake fluid with respect to antioxidation, the following test was conducted. The test on antioxidation was conducted according to the standard KS M2141 5.9. After metal specimens were subjected to the test at 23° C. for 70 hours and then allowed to stand at 70° C. for 168 hours, appearances and weight changes of the metal specimens were measured. The test is to evaluate the corrosion inhibition performance by adding benzoyl peroxide and rubber to the brake fluid. External surfaces of aluminum and cast iron specimens, which are brought into contact with a thin plate, should not be corroded to such an extent as to be observable to the naked eye.

As can be seen in Table 4, the brake fluids containing triazole and thiatriazole were about 2 to 7 times better than the comparative examples (i.e., brake fluids not containing triazole and thiatriazole) in terms of antioxidation against benzoyl peroxide. This indicated that triazole and thiatriazole improved the anti-oxidative performance of the brake fluid.

TABLE 5

| Test on equilibrium reflux boiling point and wet equilibrium reflux boiling point for respective compositions | | | | | | | | |
|---|---|---|---|---|---|---|---|---|
| Classification | | | | | | | | |
| | Standard | | | | | | | |
| Item | 3 specimens | 4 specimens | Example 1 | Example 2 | Example 3 | Example 4 | Comparative Example 1 | Comparative Example 2 |
| Equilibrium reflux boiling point | 205° C. or higher | 230° C. or higher | 250 | 252 | 263 | 270 | 250 | 270 |
| Wet equilibrium reflux boiling point | 140° C. or higher | 155° C. or higher | 150 | 150 | 161 | 170 | 150 | 170 |

In order to evaluate the excellence of the brake fluid with respect to the equilibrium reflux boiling point and wet equilibrium reflux boiling point, the following tests were conducted. The tests on equilibrium reflux boiling point and wet equilibrium reflux boiling point were conducted according to the standards KS M2141 5.1.1 and 5.1.4. As a result of the tests on equilibrium reflux boiling point and wet equilibrium reflux boiling point, as can be seen in Table 5, all the specimens showed equivalent levels of result values. This indicated that the equilibrium reflux boiling point and wet equilibrium reflux boiling point are not significantly influenced by the kind of additives in the composition of the present invention.

The invention claimed is:

1. A brake fluid composition comprising:

85 to 99 wt %, based on the total weight of the composition, of a glycol compound as a solvent;

0.5 to 10 wt %, based on the total weight of the composition, of a mixture of triazole and thiadiazole, and 0.1-5.0 wt %, based on the total weight of the composition, of an amine compound as a metal corrosion inhibitor; and 0.1-5.0 wt %, based on the total weight of the composition, of an antioxidant;

wherein the glycol compound as the solvent is comprised of 5.0-30 wt % of polyalkylene glycol and 70-85 wt % of glycol ether, based on the total weight of the solvent, wherein the glycol ether is one or more selected from the group consisting of polyethylene glycol mono-methyl ether, polyethylene glycol mono-butyl ether and triethylene glycol mono-methyl ether;

wherein the triazole is benzotriazole or tolyltriazole;

wherein the thiadiazole is 2,5-dimercapto-1,3,4-thiadiazole;

wherein the amine compound are two species selected from a group consisting of alkyl diethanol amine, cyclohexyl amine and triethanol amine; and wherein the antioxidant is dibutyl hydroxy toluene.

2. The brake fluid composition of claim 1, further comprising a boron-containing compound as the solvent.

* * * * *